United States Patent [19]

Ulrich

[11] 4,257,375

[45] Mar. 24, 1981

[54] FUEL INJECTION SYSTEM FOR MIXTURE-COMPRESSING INTERNAL COMBUSTION ENGINES WITH SPARK IGNITION

[75] Inventor: Johann-Georg Ulrich, Mühlacker, Fed. Rep. of Germany

[73] Assignee: Dr. Ing. H.c.F. Porsch Aktiengesellschaft, Fed. Rep. of Germany

[21] Appl. No.: 972,210

[22] Filed: Dec. 22, 1978

[30] Foreign Application Priority Data

Dec. 22, 1977 [DE] Fed. Rep. of Germany ..... 2757248

[51] Int. Cl.[3] ..... F02M 59/32; F02M 59/42

[52] U.S. Cl. ..... 123/453; 123/452

[58] Field of Search ..... 123/139 AW, 139 ST, 123/179 L, 464, 457, 458, 459, 453

[56] References Cited

U.S. PATENT DOCUMENTS

| | | | |
|---|---|---|---|
| 3,730,155 | 5/1973 | Knapp | 123/139 AW |
| 3,792,693 | 2/1974 | Luchaco | 123/179 L |
| 3,835,828 | 9/1974 | Knapp | 123/139 AW |
| 3,974,809 | 8/1976 | Stumpp | 123/139 AW |
| 3,993,034 | 11/1976 | Passera | 123/139 AW |
| 4,132,211 | 1/1979 | Wilfert | 123/139 ST |
| 4,150,654 | 4/1979 | Heitzman | 123/179 L |
| 4,193,384 | 3/1980 | Steiner | 123/179 L |

FOREIGN PATENT DOCUMENTS

| | | | |
|---|---|---|---|
| 2344701 | 3/1975 | Fed. Rep. of Germany | 123/139 ST |
| 2531766 | 1/1977 | Fed. Rep. of Germany | 123/189 AW |
| 2715588 | 10/1978 | Fed. Rep. of Germany | 123/179 L |

*Primary Examiner*—Charles J. Myhre
*Assistant Examiner*—Carl Stuart Miller
*Attorney, Agent, or Firm*—Craig and Antonelli

[57] ABSTRACT

Problems associated with warm engine starting of spark-ignition internal combustion engines with continuous injection into the intake manifold and fuel injection systems of the type utilizing a measuring element and a deliberately operable power control element connected in series, the measuring element being moved as a function of the air volume through-put so as to displace a fuel valve disposed in a fuel supply line for metering a volume of fuel which is proportional to the air volume and which has a warmup control connected by a control pressure line with the fuel valve and a zero-pressure fuel return line with a fuel tank for enriching the fuel-air mixture during the warmup of the internal combustion engine are avoided according to the present invention by an improvement comprising a bypass line interconnecting the control pressure line of the fuel pressure line in bypassing relationship with respect to the warmup control. A valve is disposed in the bypass line and is controlled so as to open the bypass line when the engine is started in a warmed up condition. According to a preferred embodiment, the operating parameter in response to which the valve is controlled is the temperature of the internal combustion engine.

1 Claim, 1 Drawing Figure

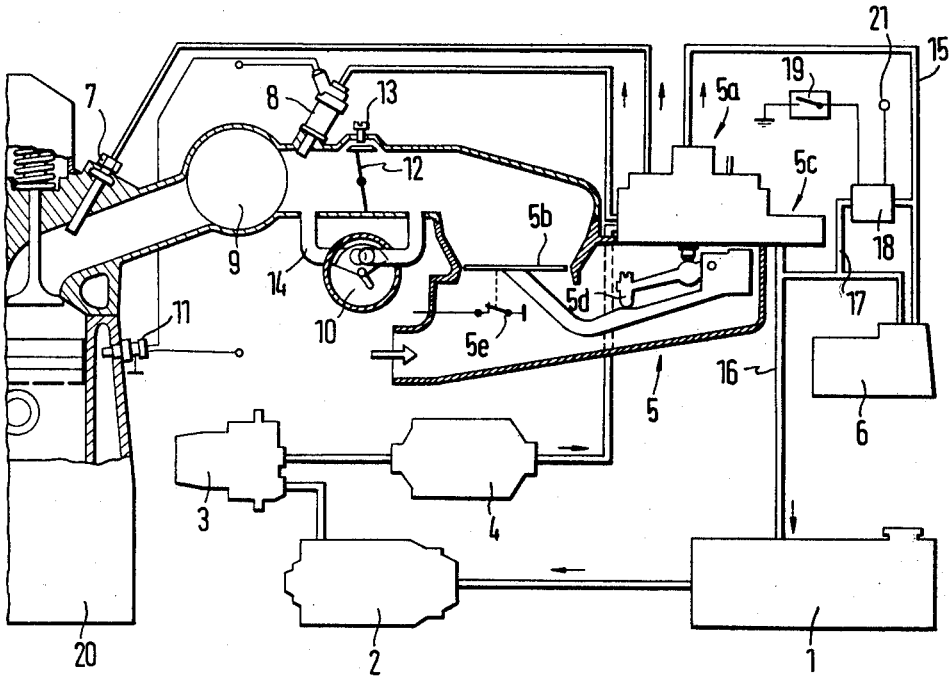
21
15
19
5a
7
8
13
12
5c
5b
18
9
14
5d
17
11
10
5e
16
5
6
3
4
20
2
1

FUEL INJECTION SYSTEM FOR MIXTURE-COMPRESSING INTERNAL COMBUSTION ENGINES WITH SPARK IGNITION

BACKGROUND AND SUMMARY OF THE INVENTION

The invention relates to a fuel injection system for mixture-compressing internal combustion engines with spark ignition, with continuous injection into the intake, wherein a measuring device and a deliberately operable power control element, e.g., a throttle valve, are connected in series and the measuring element is moved as a function of the air volume throughput, thereby displacing a fuel valve disposed in the fuel supply line to meter a volume of fluid proportional to the air volume, and further connected with a warmup control for enriching the fuel-air mixture during warmup of the internal combustion engine, whereby the warmup control is connected to the fuel valve by a control pressure line and via a zero-pressure fuel return line with the fuel tank.

Internal combustion engines with fuel injection systems of the type described hereinabove are known (Bosch, Technical Manual, K-Jetronic Gasoline Fuel Injection, First Edition, February 1974) wherein an enriched fuel-air mixture is supplied during the warmup phase of the internal combustion engine to compensate for condensation losses in the cold combustion chambers and on the intake walls of the internal combustion engine. This control is accomplished by a warmup control which influences the control pressure of the fuel injection system, said control consisting of a spring-loaded control valve, said valve being controlled by an electrically heated bimetallic strip. When the internal combustion engine has reached operational temperature, the warmup control maintains the control pressure at a constant overpressure. This warmup control is so mounted on the internal combustion engine that it assumes the temperature of the internal combustion engine. When the internal combustion engine is started in a warm or hot condition, this avoids fuel enrichment beyond the phase of the control pressure rise.

In fuel injection systems for internal combustion engines, however, it has been found that after a hot internal combustion engine is shut off, the fuel in the injection lines evaporates. If the internal combustion engine is then started in a warm or hot condition, the brief fuel enrichment during the control pressure rise phase is insufficient to supply the injection lines with a volume of fuel which allows immediate catching of the internal combustion engine.

Thus, a goal of the invention is to improve the starting times of internal combustion engines in a warm or hot condition.

This goal is achieved according to a preferred embodiment of the invention by virtue of the fact that the control pressure line and the fuel return line bypass the warmup control and are connected with one another by a bypass line, wherein a valve is disposed, said valve being controllable as a function of an operating parameter of the internal combustion engine. In this fashion, the time interval between the starting and catching of the internal combustion engine can be reduced to an optimum value by simple means. Moreover, these means, which are characterized by low manufacturing cost and high operational reliability, are suitable for retrofitting on motor vehicles without incurring considerable expense.

It has been found to be expecially advantageous to make the valve as a solenoid valve and to make the operating parameter the temperature of the internal combustion engine.

These and further objects, features and advantages of the present invention will become more obvious from the following description when taken in connection with the accompanying drawing which shows, for purposes of illustration only, a single embodiment in accordance with the present invention.

BRIEF DESCRIPTION OF THE DRAWING

The sole FIGURE of the drawing illustrates an air-metering drive-less fuel injection system with continuous fuel feed according to a preferred embodiment of the invention.

DETAILED DESCRIPTION OF THE PREFERRED EMBODIMENT

In the fuel injection system shown in the drawing, reference No. 1 is a fuel tank, from which tank the fuel is supplied by an electric fuel pump 2 via a fuel accumulator 3 and a fuel filter 4 to a mixture metering device 5. Mixture metering device 5 comprises a fuel metering device 5*a*, an air metering device 5*b*, a system pressure control 5*c*, a mixture adjusting screw 5*d*, and an air metering device contact 5*e*. Reference numeral 6 represents a warmup control, 7 is an injection valve, 8 an electric starting valve, 9 an intake manifold, 10 an auxiliary air shutter, 11 a thermostatic time switch, 12 a power control element, for example, a throttle valve, and 13 is an idle-adjusting screw. Auxiliary air shutter 10 is disposed in an air bypass line 14 which bypasses power control element 12. A control pressure line which connects fuel distributor 5*a* with warmup control 6 is represented by 15 and a zero-pressure fuel return line which connects warmup control 6 and system pressure control 5*c* with fuel tank 1 is represented by 16. Control pressure line 15 is connected to fuel return line 16, bypassing warmup control 6, by a fuel bypass line 17, said bypass line 17 containing a solenoid valve 18, said valve being influenceable by a temperature switch 19 affected by the temperature of the internal combustion engine, with the starter voltage being applied to terminal 21 of said solenoid valve 18. Reference numeral 20 indicates an internal combustion engine.

The system according to the preferred embodiment of the invention functions as follows:

The fuel injection system shown is a mechanical, continuous injection system for gasoline engines which does not require any driving connection (e.g., a belt drive take-off) with the internal combustion engine. The fuel is delivered by an electrically driven roller vane pump 2. The volume of air drawn in by internal combustion engine 20 during operation (bold arrow shown in drawing) is measured by an air metering device 5*b*, said device being installed upstream of power control element 12 with respect to internal combustion engine 20. Depending on the position of the power control element 12 and/or the accelerator, more or less air is drawn in. Depending on the metered air volume, fuel distributor 5*a* supplies the individual cylinders of internal combustion engine 20, via corresponding injection valves 7, with a fuel volume which ensures an optimal mixture as far as engine performance, fuel consumption, and exhaust gas composition are concerned. Air metering device 5b and fuel distributor 5a are combined in a unit known as the mixture metering device 5. Devices of this type are described, for example, in U.S. Pat. No. 3,835,828. The exactly metered volume of fuel is conducted to the injection valves, said valves spraying the fuel in a finely atomized form continuously into the intake manifold upstream of the intake valves of the cylinders of internal combustion engine 20. The fuel is then drawn together with the air into the internal combustion engine cylinders when the intake valves open. If necessary, the fuel injection system is available as a corrective unit for the warmup phase of the internal combustion engine.

During the warmup phase of an internal combustion engine, there are essentially two corrections which are required to by made by contrast with the operationally warm state:

1. Compensation of condensation losses at the cold combustion chamber walls and intake manifold walls;
2. Compensation of increased friction.

Increased friction can be overcome by adding a larger amount of the fuel-air mixture than corresponds to the position of the power control element. This is achieved by bypassing the power control element through auxiliary air shutter 10. The cross section of the latter is controlled by a perforated disk 22, as a function of the heating of an electrically heated bimetallic strip. In the operationally ready state, the auxiliary cross section is closed.

Condensation losses are compensated by a richer fuel-air mixture. This task is accomplished by warmup control 6. When the internal combustion engine is cold, the control pressure of the fuel injection system, controlled in a known manner by an electrically heated bimetallic strip in the warmup control, is approximately 0.5 to 1 bar (such electrically heated bimetallic strips are described in the above-noted Bosch Manual). When the cold internal combustion engine is started, electrical heating to the bimetallic strip is switched on, causing a rise in control pressure. When the warmup phase is over, the control pressure will have reached its normal value of approximately 3.7 bars pressure.

To avoid the previously noted problems of prior art fuel systems which occur when the internal combustion engine is started when hot, according to the present invention, temperature switch 19 is closed and a bypass line 17 is opened by a solenoid valve 18. As a result, the control pressure, depending on the arrangement of the bypass line, remains at a value below its normal pressure of approximately 3.7 bars overpressure, whereby an excessively large fuel volume is supplied to injection valves 7. When internal combustion engine 20 starts, terminal 21 carries zero voltage, solenoid valve 18 closes bypass line 17, and the control pressure rises to its normal pressure so that only a proportionately large fuel volume is supplied to injection valves 7.

While I have shown and described one embodiment in accordance with the present invention, it is understood that the same is not limited thereto but is susceptible of numerous changes and modifications as known to those skilled in the art. For example, the bypass line can also be controlled by a time-delay relay, an r.p.m. relay, the starter current, or the intake manifold vacuum. Therefore, I do not wish to be limited to the details shown and described herein but intend to cover all such changes and modifications as are encompassed by the scope of the appended claims.

I claim:

1. In a fuel injection system for mixture- compressing, spark-ignition internal combustion engines with continuous injection into the intake manifold, of the type having a starter, a measuring element and a deliberately operable power control element connected in series, said measuring element being moved as a function of the air volume through-put, so as to displace a fuel valve disposed in a fuel supply line for metering a volume of fuel which is proportional to the air volume, and a warmup control for enriching the fuel-air mixture during the warmup of an internal combustion engine, the warm-up control being connected by a control pressure line with the fuel valve and by a zero-pressure fuel return line with a fuel tank, the improvement comprising a bypass line interconnecting the control pressure line and the fuel return line in bypassing relationship with respect to said warm-up control, and a solenoid valve disposed in said bypass line, and means for controlling said valve as a function of the temperature of the internal combustion engine and the starter voltage, wherein the valve in the bypass line, the control means therefor, and the starter are constructed and interconnected for opening said bypass line only when the temperature of the engine is above a predetermined value during operation of said starter, said bypass line being closed in response to closing of the solenoid valve when said starter voltage is zero.

* * * * *